US009728899B2

(12) United States Patent
Peng et al.

(10) Patent No.: US 9,728,899 B2
(45) Date of Patent: Aug. 8, 2017

(54) ELECTRICAL CONNECTOR

(71) Applicant: LOTES CO., LTD, Keelung (TW)

(72) Inventors: Jian Min Peng, Keelung (TW); Zhi Lin Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/386,372

(22) Filed: Dec. 21, 2016

(65) Prior Publication Data

US 2017/0194748 A1 Jul. 6, 2017

(30) Foreign Application Priority Data

Dec. 30, 2015 (CN) ..... 2015 2 1118161 U

(51) Int. Cl.

| | |
|---|---|
| ***H01R 13/6581*** | (2011.01) |
| ***H01R 13/6597*** | (2011.01) |
| ***H01R 24/64*** | (2011.01) |
| *H01R 107/00* | (2006.01) |

(52) U.S. Cl.

CPC ..... *H01R 13/6581* (2013.01); *H01R 13/6597* (2013.01); *H01R 24/64* (2013.01); *H01R 2107/00* (2013.01)

(58) Field of Classification Search

CPC ..... H01R 13/6581; H01R 13/6585; H01R 13/6593; H01R 13/6597; H01R 13/65802; H01R 24/64; H01R 2107/00

USPC ..... 439/607.27, 95, 96, 607.05, 607.34, 439/607.55

See application file for complete search history.

(56) References Cited

U.S. PATENT DOCUMENTS

| | | | | |
|---|---|---|---|---|
| 4,687,267 | A * | 8/1987 | Header | H01R 12/725 439/607.07 |
| 5,114,355 | A * | 5/1992 | Kimmel | H01R 23/6873 439/101 |
| 5,151,033 | A * | 9/1992 | Kawai | H01R 13/648 439/95 |
| 5,240,424 | A * | 8/1993 | Honma | H01R 13/623 439/95 |
| 6,540,556 | B1 * | 4/2003 | Fu | H01R 13/6597 439/108 |
| 7,416,428 | B1 * | 8/2008 | Hung | H01R 12/57 439/188 |
| 7,510,408 | B2 * | 3/2009 | Tsurumi | H01R 13/506 439/680 |
| 8,808,029 | B2 * | 8/2014 | Castillo | H01R 13/6585 439/607.05 |
| 8,997,345 | B2 * | 4/2015 | Liu | H01R 43/24 29/825 |

(Continued)

*Primary Examiner* — Tulsidas C Patel
*Assistant Examiner* — Travis Chambers
(74) *Attorney, Agent, or Firm* — Locke Lord LLP; Tim Tingkang Xia, Esq.

(57) ABSTRACT

An electrical connector includes an insulating body, a middle shielding sheet disposed in the insulating body, at least one row of terminals disposed in the insulating body and located on one side of the middle shielding sheet, an inner metal shell arranged on the insulating body, and an outer metal shell, enclosing the insulating body and the inner metal shell to form a mating cavity. The row of terminals includes at least one ground terminal. The ground terminal is projected laterally to form an urging portion. The inner metal shell at least partially encloses the terminals and the middle shielding sheet, and is in contact with the plate edge of the urging portion.

16 Claims, 6 Drawing Sheets

(56) References Cited

U.S. PATENT DOCUMENTS

| | | | | |
|---|---|---|---|---|
| 9,022,800 | B2 * | 5/2015 | Yang | H01R 13/6581 439/487 |
| 9,525,241 | B1 * | 12/2016 | Su | H01R 13/6581 |
| 9,577,387 | B2 * | 2/2017 | Hu | H01R 13/6597 |
| 9,601,876 | B2 * | 3/2017 | Jiang | H01R 13/6585 |
| 9,640,923 | B2 * | 5/2017 | Kao | H01R 12/724 |
| 2016/0013591 | A1 * | 1/2016 | Ueda | H01R 13/6581 439/607.28 |
| 2016/0087378 | A1 * | 3/2016 | Chen | H01R 12/724 439/607.34 |
| 2016/0149350 | A1 * | 5/2016 | Kao | H01R 24/60 439/607.05 |

* cited by examiner

ELECTRICAL CONNECTOR

CROSS-REFERENCE TO RELATED APPLICATION

This non-provisional application claims priority to and benefit of, under 35 U.S.C. §119(a), Patent Application No. 201521118161.7 filed in P.R. China on Dec. 30, 2015, the entire content of which is hereby incorporated by reference.

FIELD OF THE INVENTION

The invention relates to an electrical connector, and more particularly to an electrical connector capable of decreasing electromagnetic interference.

BACKGROUND OF THE INVENTION

In an existing electrical connector for transmitting high-frequency signals, it is common that electromagnetic interference will be generated between terminals, and how to solve and decrease electromagnetic interference has become an important topic researched by the industry.

For example, a newly emerging USB TYPE C connector includes an insulating body and two rows of terminals arranged in the insulating body. Each row of terminals include: a ground terminal, a pair of differential signal terminals for transmitting high-frequency signals, a power terminal, a reserved terminal, a pair of signal terminals, a reserved terminal, a power terminal, a pair of differential signal terminals for transmitting high-frequency signals, and a ground terminal. Since there are differential signal terminals for transmitting high-frequency signals in both the upper and lower rows of terminals of such a connector, during use, electromagnetic interference is prone to occur.

Therefore, a heretofore unaddressed need exists in the art to address the aforementioned deficiencies and inadequacies.

SUMMARY OF THE INVENTION

In one aspect, the present invention relates to an electrical connector that has decreased electromagnetic interference.

In certain embodiments, an electrical connector includes an insulating body, a middle shielding sheet arranged in the insulating body, at least one row of terminals arranged in the insulating body and located on one side of the middle shielding sheet, an inner metal shell at least partially enclosing the terminals and the middle shielding sheet, and an outer metal shell enclosing the insulating body and the inner metal shell to form a matting cavity. The at least one row of terminals includes at least one ground terminal. The ground terminal protrudes laterally to form an urging portion. The inner metal shell is in contact with the plate edge of the urging portion.

In certain embodiments, the urging portion is connected with the inner metal shell by spot welding.

In certain embodiments, among the row of terminals, the outermost terminals located at both sides are ground terminals. A sheet metal is blanked to form the ground terminals, the urging portions are integrally formed during blanking, and the plate edges of the urging portions are in contact with the inner wall of the inner metal shell. The insulating body includes a base and a tongue extending forward from the base, and the urging portions are located at least partially in the base. Each ground terminal has a main body located in the base, and the urging portion extends outward from the main body along a direction perpendicular to the main body.

In certain embodiments, the inner metal shell is provided with a sidewall buried in the insulating body, and the urging portions are in contact with the sidewall in the insulating body. The inner metal shell is also provided with a sidewall exposed outside the insulating body, and the urging portions protrude out of the insulating body to be in contact with the sidewall.

In certain embodiments, the electrical connector further includes an upper insulator and a lower insulator. One row of terminals are insert-molded into the upper insulator to form a first terminal module. The other row of terminals insert-molded into the lower insulator to form a second terminal module. The insulating body is formed by the first terminal module, the second terminal module, and the middle shielding sheet by insert molding again, and the insulating body wraps the first terminal module, the second terminal module and the middle shielding sheet.

In certain embodiments, both sides of the middle shielding sheet are respectively protruded laterally to form a contact portion to be in contact with the inner metal shell. The contact portions are integrally formed when a sheet metal is blanked, and the plate edges of the contact portions urge against the inner wall of the inner metal shell.

In another aspect, the present invention relates to an electrical connector. In certain embodiments, an electrical connector includes an insulating body extending along the longitudinal direction, an inner metal shell fixed on the insulating body, a plurality of terminals arranged on the insulating body, and an outer metal shell, enclosing the insulating body and the inner metal shell to form a mating cavity. The plurality of terminals includes a ground terminal. The ground terminal is horizontally protruded outward to form an urging portion. The urging portion is in contact with the inner metal shell.

In certain embodiments, the urging portion is connected with the inner metal shell by spot welding. A sheet metal is blanked to form the ground terminals, the urging portions are formed integrally during blanking, and the plate edges of the urging portion are in contact with the inner wall of the inner metal shell. Each ground terminal has a main body extending along the longitudinal direction, and the urging portion extends perpendicular to the main body, and is coplanar with the main body. The insulating body includes a base and a tongue extending forward from the base. The inner metal shell has an annular portion fixed on the base and two covering portions extending forward from the annular portion and respectively covering the upper and lower surfaces of the tongue. The urging portions rigidly urge against the inner wall of the annular portion. The plurality of terminals are arranged in an upper row and a lower row, a middle shielding sheet is arranged between the two rows of terminals, and the plate edges of both sides of the middle shielding sheet are respectively projected horizontally to be in rigid contact with the inner metal shell.

Compared with the related art, the ground terminals according to certain embodiments of the present invention are directly projected laterally or horizontally to form the urging portions to be in contact with the inner metal shell, and such a structure does not require the ground terminals to be stamped to bend to form a bent structure, and also does not require the inner metal shell to be pierced and bent to form an elastic sheet structure, so that the machining process is effectively simplified. The inner metal shell is electrically conducted with the ground terminals, so that the inner metal shell can be connected to a ground line on a circuit board through the ground terminals, the inner metal shell and the ground terminals are grounded together, so that the inner metal shell can also produce a shielding effect, thereby further reducing electromagnetic interference in the transmission of high-frequency signals by the electric connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

Figure 1:
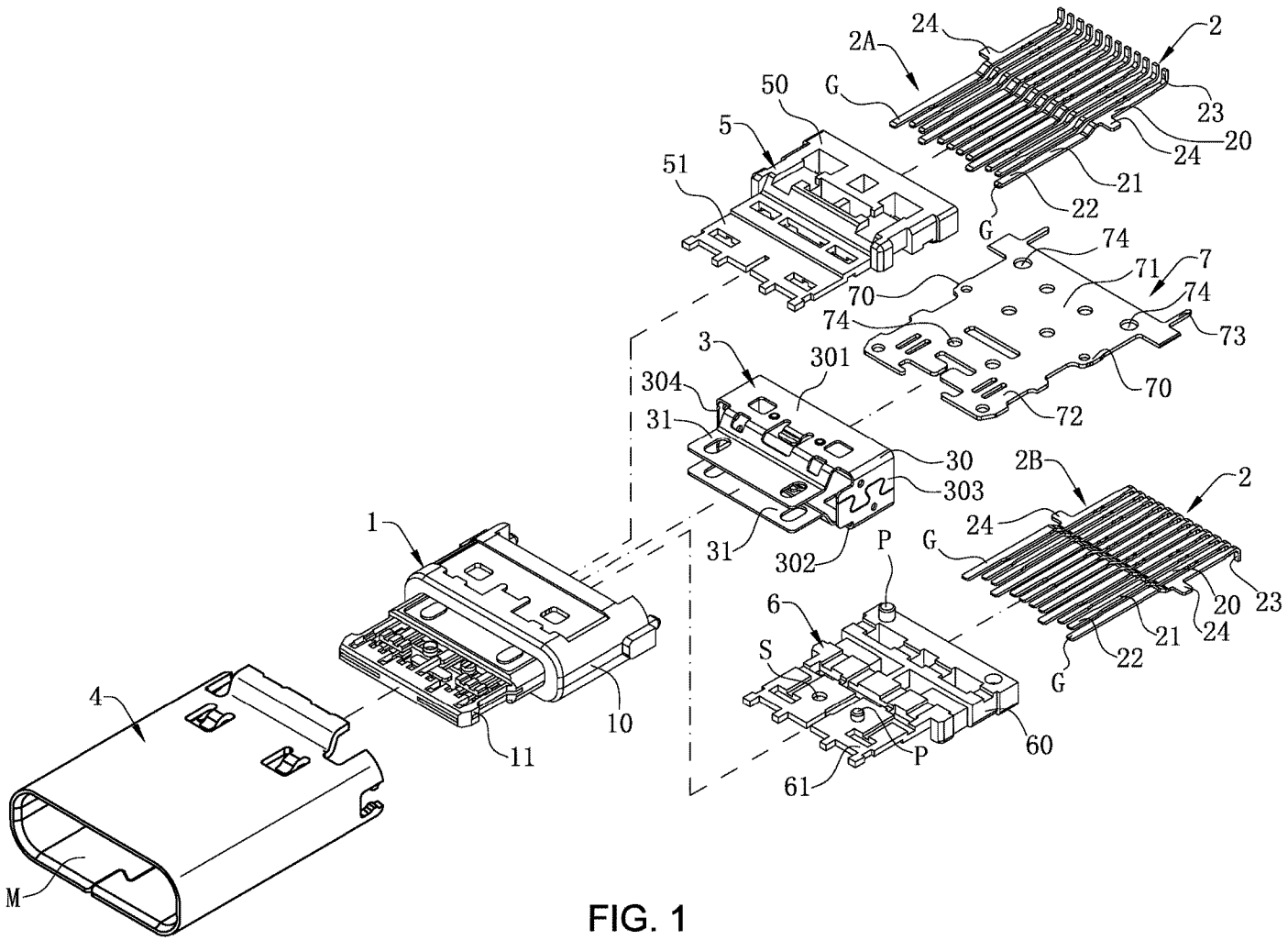
FIG. 1 is a schematic exploded view of an electrical connector according to one embodiment of the present invention.

The numbers in the drawings of an embodiment are described as follows:

DETAILED DESCRIPTION OF THE INVENTION

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
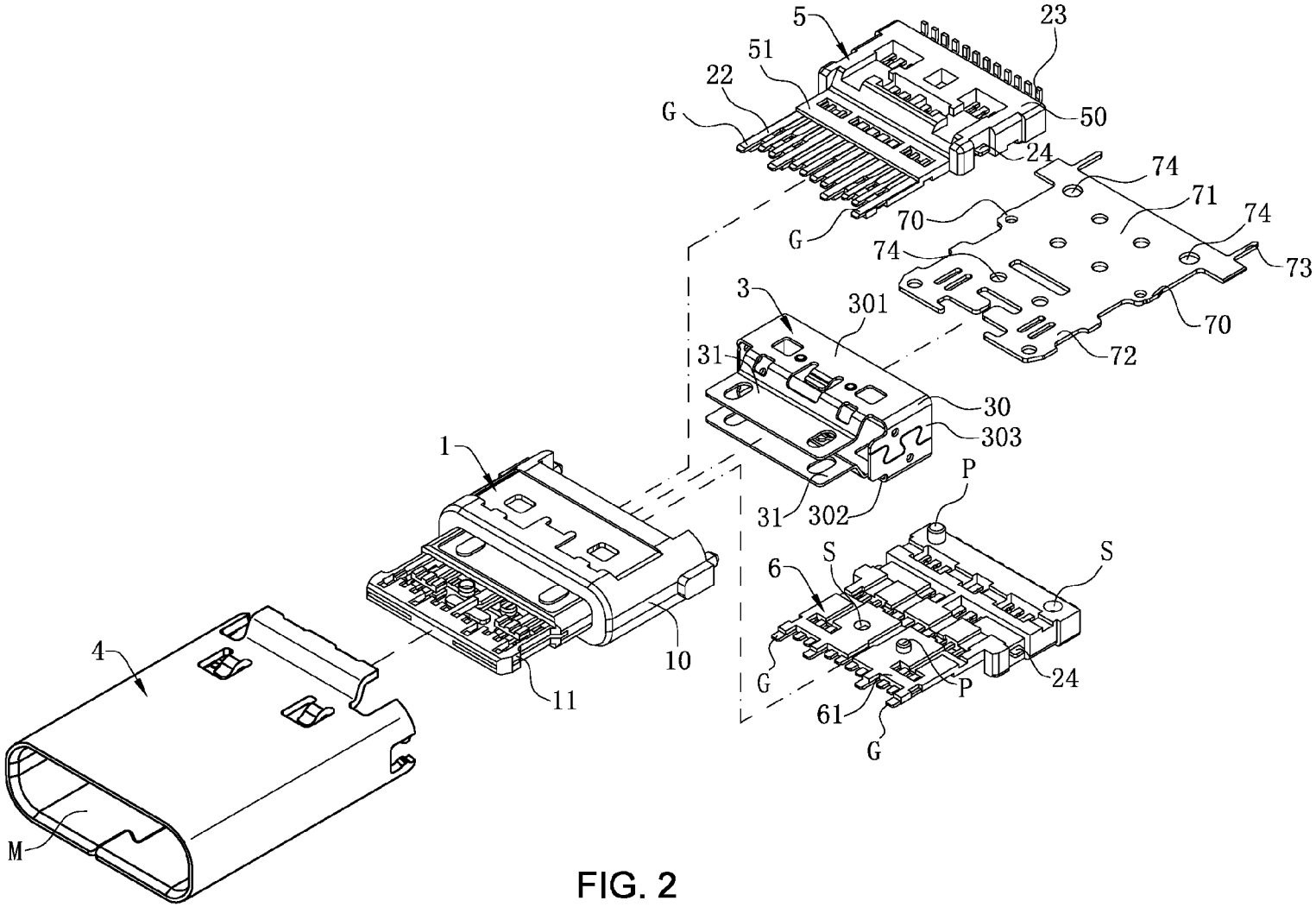
FIG. 2 is a partially exploded view of the electrical connector in FIG. 1.

As shown in FIG. 1 and FIG. 2, an electrical connector according to certain embodiments of the present invention includes an insulating body 1, multiple terminals 2 arranged in the insulating body 1, an inner metal shell 3 fixed on the insulating body 1, and an outer metal shell 4 enclosing the insulating body 1 and the inner metal shell 3 to form a mating cavity M for a mating connector (not shown) to be inserted therein.

As shown in FIG. 1 and FIG. 2, in the embodiment, the electrical connector includes an upper insulator 5, a lower insulator 6, and the insulating body 1, and the multiple terminals 2 are divided into an upper row and a lower row. The upper row of terminals 2A are insert-molded into the upper insulator 5 to form a first terminal module, the lower row of terminals 2B are insert-molded into the lower insulator 6 to form a second terminal module, and a middle shielding sheet 7 is arranged between the first terminal module and the second terminal module. After the first terminal module and the second terminal module are assembled together, the inner metal shell 3 sleeves the first terminal module and the second terminal module, insert molding is performed again to form the insulating body 1. The insulating body 1 at least partially wraps the first terminal module, the second terminal module and the inner metal shell 3.

Specifically, the upper insulator 5 has an upper base 50 and an upper tongue 51 extending forward from the upper base 50. The thickness of the upper base 50 is greater than that of the upper tongue 51. The bottoms of the upper base 50 and the upper tongue 51 are respectively provided with a positioning post P and a positioning hole S (not shown, but can refer to the corresponding structure on the lower insulator 6). Similarly, the lower insulator 6 includes a lower base 60 and a lower tongue 61 extending forward from the lower base 60. The thickness of the lower base 60 is greater than that of the lower tongue 61. The tops of the lower base 60 and the lower tongue 61 are respectively provided with a positioning post P and a positioning hole S. The positioning hole S of the lower insulator 6 correspondingly matches with the positioning post P of the upper insulator 5, the positioning hole S of the upper insulator 5 correspondingly matches with the positioning post P of the lower insulator 6, thereby assembling and fixing the upper insulator 5 and the lower insulator 6. The insulating body 1 also has a base 10 and a tongue 11 extending forward from the base 10. The base 10 wraps the upper base 50 and the lower base 60, the tongue 11 completely wraps the rear parts and left and right sides of the upper tongue 51 and the lower tongue 61, and the tongue 11 also wraps the front end surfaces of the upper tongue 51 and the lower tongue 61.

Figure 3:
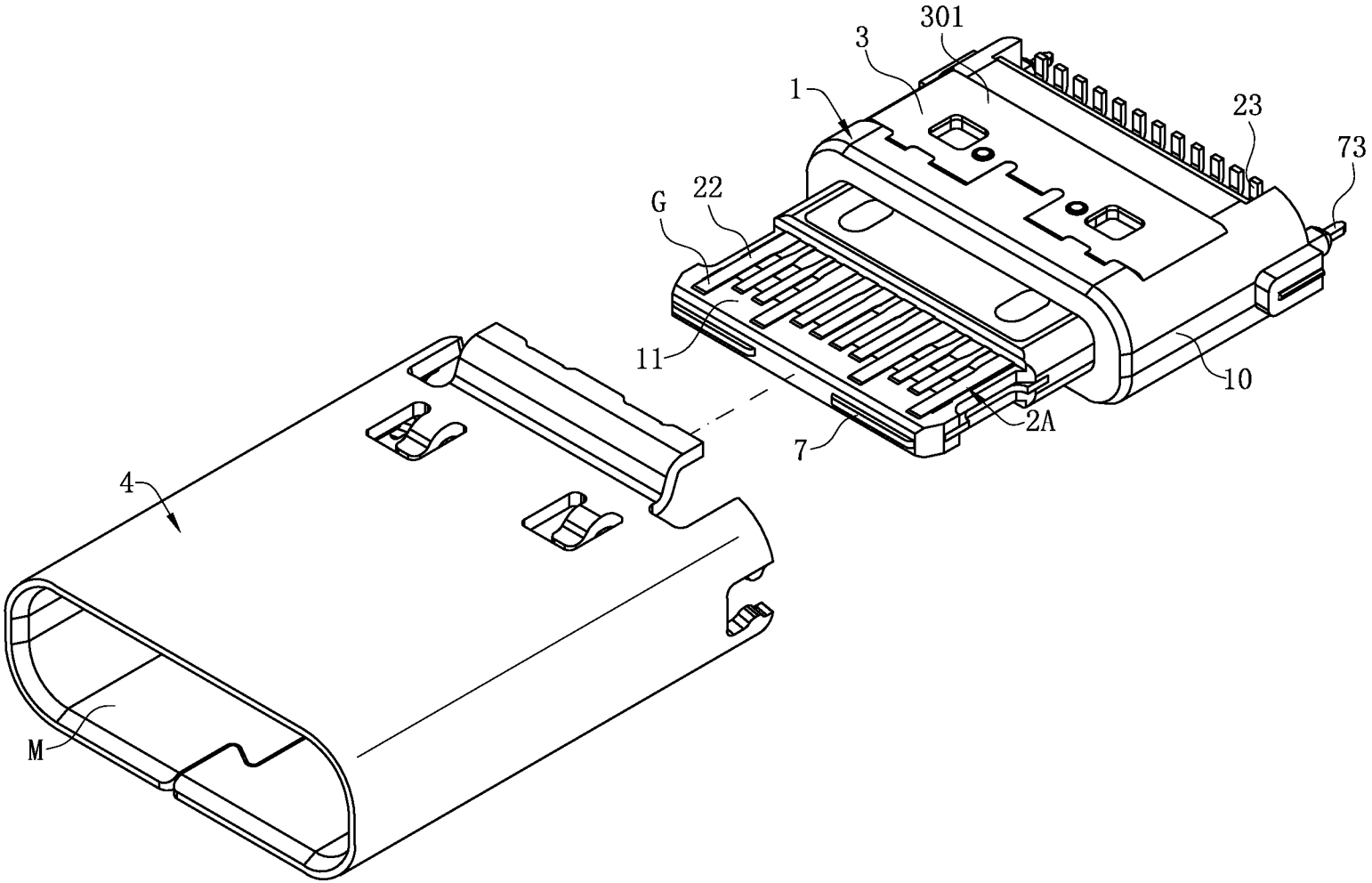
FIG. 3 is a schematic view of FIG. 2 before assembling the outer metal shell.
Figure 4:
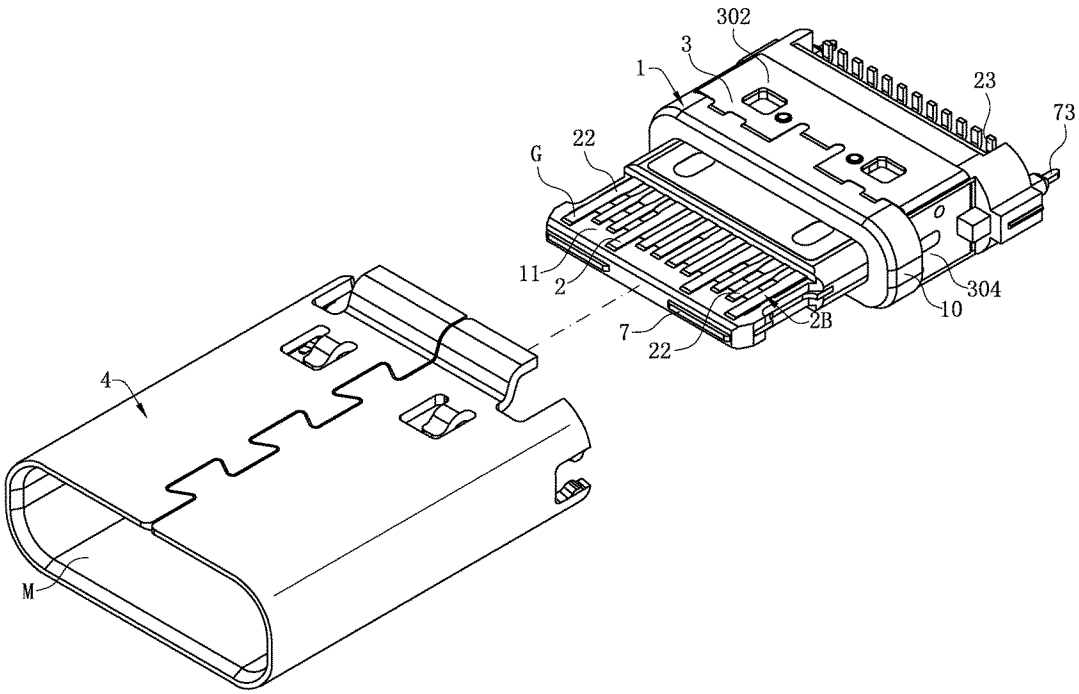
FIG. 4 is a schematic inverted view of FIG. 3.

As shown in FIGS. 2-4, a sheet metal is stamped to form the inner metal shell 3, which is embedded at least partially in the insulating body 1. The inner metal shell 3 at least partially encloses the terminals 2 and the middle shielding sheet 7. In the embodiment, the inner metal shell 3 includes an annular portion 30 fixed on the base 10 and two covering portions 31 extending forward from the annular portion 30 and respectively covering the upper and lower surfaces of the tongue 11. Specifically, the inner metal shell 3 is assembled on the first terminal module and the second terminal module. The annular portion 30 sleeves the upper base 50 and the lower base 60, and partially encloses the upper row of terminals 2A, the lower row of terminals 2B and the middle shielding sheet 7. The two covering portions 31 respectively extend forward from the top and bottom of the annular portion 30, and respectively wrap the outer surfaces of the upper tongue 51 and the lower tongue 61 so as to be located around the upper row of terminals 2A, the lower row of terminals 2B and the middle shielding sheet 7. The annular portion 30 has a top wall 301, a bottom wall 302, and a left sidewall 303 and a right sidewall 304 connected to the top wall 301 and the bottom wall 302. One sidewall 303 is buried in the base 10 of the insulating body 1, while the other sidewall 304 is exposed out of the base 10 of the insulating body 1.

Each row of terminals 2 are arranged sequentially in a left-right direction a ground terminal, a pair of first differential signal terminals, a power terminal, a reserved terminal, a pair of third signal terminals, a reserved terminal, a power terminal, a pair of first differential signal terminals and a ground terminal. The two rows of terminals are arranged in central symmetry, so the electrical connector may be inserted in dual orientation.

A sheet metal is blanked and stamped to form the terminals 2. The structure of the lower row of terminals 2B is similar to the structure of the upper row of terminals 2A, so only the upper row of terminals 2A are taken as an example for illustration herein. Each terminal 2 among the upper row of terminals 2A has a main body 20 extending along a longitudinal direction. The main body 20 is embedded in the upper base 50, and therefore is also located in the base 10. A connecting portion 21 extends forward from the main body 20, and is embedded in the rear part of the upper tongue 51. A conducting portion 22 extends forward from the connecting portion 21, and the upper surface of the conducting portion 22 is exposed to the upper surface of the upper tongue 51, and is further exposed to the upper surface of the tongue 11 in order to be in contact with the mating connector. The front end of the conducting portion 22 is beyond the front end surface of the upper tongue 51 in order to be inserted into the front end of the tongue 11. The rear end of the main body 20 extends to go beyond the rear end surface of the upper insulator 5 and is bent to form a soldering portion 23, which is used to be soldered on a circuit board C.

Figure 5:
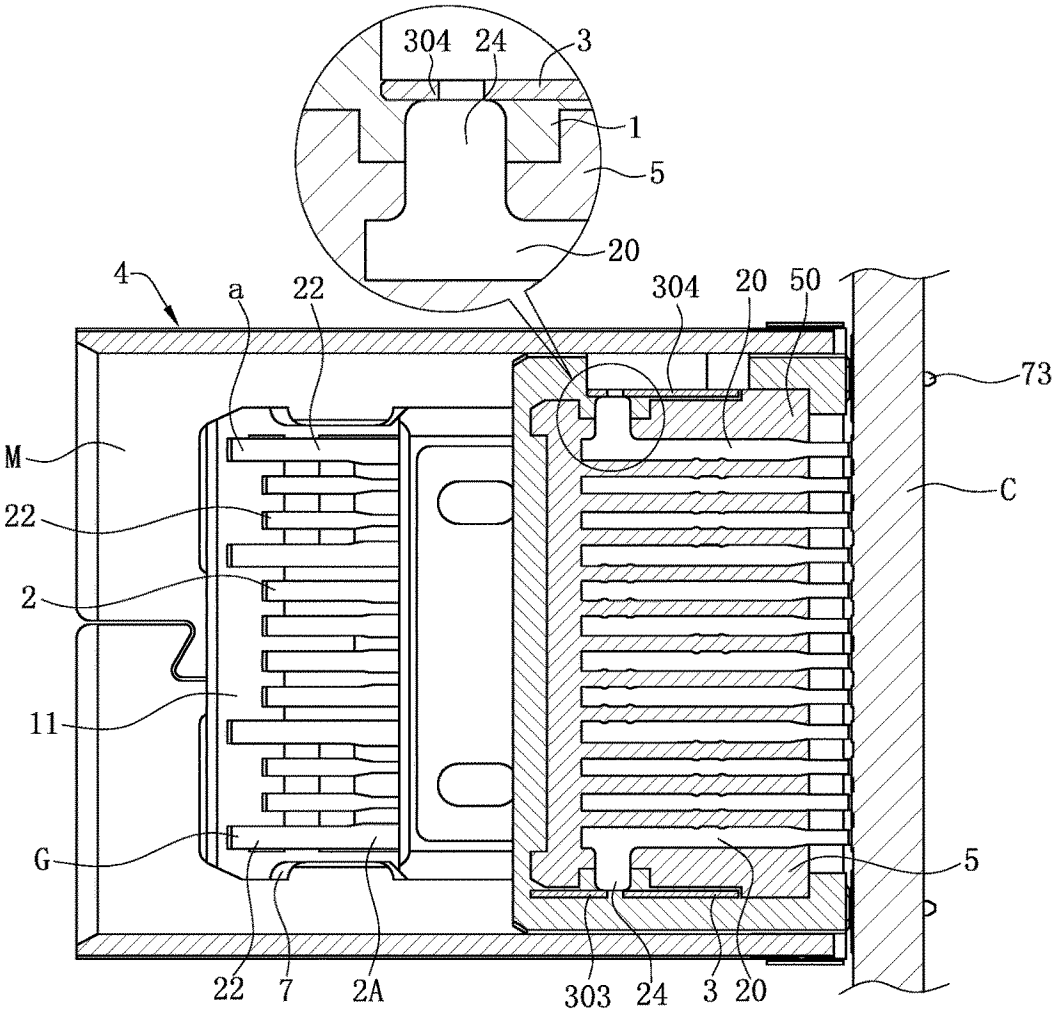
FIG. 5 is a sectional view of the plane of the upper row of terminals and a partially enlarged view thereof when the electrical connector according to one embodiment of the present invention is soldered on a circuit board.

As shown in FIG. 1 and FIG. 5, the outermost terminals among the upper row of terminals 2A are ground terminals G. The main body 20 of each ground terminal G is further projected outward along the horizontal direction to form an urging portion 24. The urging portion 24 protrudes out of the upper base 50. Specifically, the urging portion 24 is of a rigid structure which is formed integrally when the sheet metal is blanked, the urging portion 24 and the main body 20 are on the same plane, but the urging portion 24 is perpendicular to the main body 20.

The urging portion 24 is located at least partially in the base 10. In the embodiment, among the two ground terminals G of the same row, the urging portion 24 of one ground terminal G is located completely in the base 10 of the insulating body 1, the plate edge thereof is in contact with the sidewall 303 embedded in the base 10 on the inner metal shell 3, and the position of contact between both is located completely in the base 10. The urging portion 24 of the other ground terminal G protrudes out of the base 10 of the insulating body 1, and the plate edge thereof is in contact with the sidewall 304 exposed out of the base 10 on the inner metal shell 3. Since each urging portion 24 is formed by being projected laterally from the main body 20 and does not have elasticity, the plate edge thereof will be in rigid contact with the inner wall of the inner metal shell 3. In order to ensure that the urging portions 24 can truly be in contact with the inner metal shell 3, the urging portions 24 are spot-welded on the inner metal shell 3, so that the reliability of contact between them is further enhanced.

Figure 6:
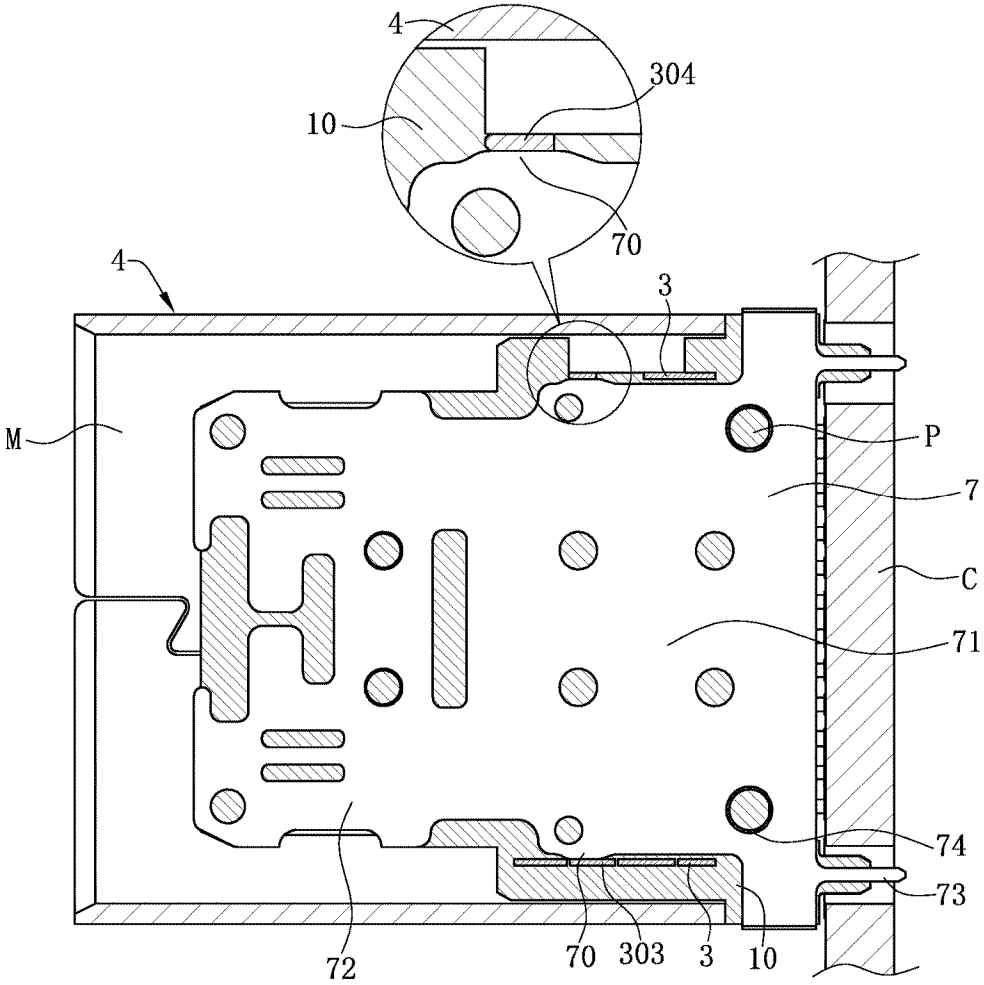
FIG. 6 is a sectional view of the plane of a middle shielding sheet and a partially enlarged diagram thereof in FIG. 5.

As shown in FIG. 1 and FIG. 6, the middle shielding sheet 7 is disposed between the first terminal module and the second terminal module, and both sides of the middle shielding sheet 7 are respectively projected laterally to form a contact portion 70 to be in contact with the inner metal shell 3. Specifically, a sheet metal is blanked to form the plate-like middle shielding sheet 7, which has a plate portion 71 located between the upper insulator 5 and the lower insulator 6 and embedded in the base 10. The contact portions 70 are formed by being respectively horizontally projected outward from both sides of the plate portion 71. The contact portions 70 are formed integrally when the sheet metal is blanked, and the plate edges of the contact portions urge against the inner wall of the inner metal shell 3 to be in rigid contact with the inner metal shell 3. Two plugging legs 72 extend backward from the plate portion 71 and are used to be plugged in the ground path of the circuit board C. In this way, the ground terminals G, the middle shielding sheet 7 and the inner metal shell 3 are grounded as a whole to guarantee multi-path grounding and realize a shielding effect. In addition, an extension portion 73 extends forward from the plate portion 71 and is embedded in the tongue 11 and located between the upper tongue 51 and the lower tongue 61 to shield electromagnetic interference between the upper row of terminals 2A and the lower row of terminals 2B. The plate portion 71 and the extension portion 73 are respectively provided with through holes 74 for the passage of the positioning posts P.

The outer metal shell 4 sleeves the insulating body 1 and the inner metal shell 3, and wraps the insulating body 1 and the inner metal shell 3. Specifically, the rear end of the outer metal shell 4 is in electric contact with the annular portion 30 of the inner metal shell 3, while the front end is a certain distance away from the tongue 11 and the shielding part covering portion 31, thereby forming the mating cavity M.

The specific manufacturing steps of the electrical connector of the present invention are as follows: firstly, the two rows of terminals, the upper insulator 5 and the lower insulator 6 mentioned above are provided, the upper insulator 5 and the upper row of terminals 2A are formed into the first terminal module by insert molding, and the lower insulator 6 and the lower row of terminals 2B are formed into the second terminal module by insert molding; then, the middle shield sheet 7 is arranged between the first terminal module and the second terminal module, and each positioning post P is aligned with each positioning hole S and each through hole 74, so that the first terminal module and the second terminal module are correspondingly assembled together; then, the inner metal shell 3 is assembled on the first terminal module and the second terminal module; then, the insulating body 1 is formed on the one-piece structure by insert molding again, and the insulating body 1 wraps the first terminal module, the second terminal module and the middle shielding sheet 7; and finally, the outer metal shell 4 is assembled.

In other embodiments, the electrical connector can also have only one row of terminals arranged on the insulating body 1. Among the row of terminals, the outermost terminals located at both sides are ground terminals G, and the ground terminals G rigidly urge against the inner metal shell 3 by directly projected laterally to form urging portions 24.

Compared with the related art, certain embodiments of the present invention have the following beneficial advantages.

1. Since the ground terminals G are directly projected laterally or horizontally to form the urging portions 24 to be in contact with the inner metal shell 3, such a structure does not require the ground terminals G to be stamped to bend to form a bent structure, and also does not require the inner metal shell 3 to be pierced and bent to form an elastic sheet structure, the machining process is effectively simplified.

2. The inner metal shell 3 is conducted electrically with the ground terminals G, so that the inner metal shell 3 can be connected to a ground line on the circuit board C through the ground terminals G. The inner metal shell 3 and the ground terminals G are grounded together, so that the inner metal shell 3 can also produce a shielding effect, thereby further reducing electromagnetic interference in the transmission of high-frequency signals by the electric connector.

3. The urging portions 24 are further connected to the inner metal shell 3 by spot welding, so the reliability of contact between both is further enhanced.

4. Both sides of the middle shielding sheet 7 are respectively projected laterally to form a contact portion 70 to be in contact with the inner metal shell 3. The contact portions 70 are formed when the sheet metal is blanked, so the machining method is simple. Moreover, the integral grounding of the ground terminals G, the middle shielding sheet 7 and the inner metal shell is realized, thereby guaranteeing multi-path grounding and realizing a shielding effect.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body;

a middle shielding sheet disposed in the insulating body;

at least one row of terminals disposed in the insulating body and located on one side of the middle shielding sheet, wherein the at least one row of terminals comprises at least one ground terminal, and the at least one ground terminal protrudes laterally to form an urging portion;

an inner metal shell arranged on the insulating body, the inner metal shell at least partially enclosing the terminals and the middle shielding sheet, and the inner metal shell being in contact with a plate edge of the urging portion; and an outer metal shell, enclosing the insulating body and the inner metal shell to form a mating cavity.

2. The electrical connector of claim 1, wherein the urging portion is connected with the inner metal shell by spot welding.

3. The electrical connector of claim 1, wherein a sheet metal is blanked to form the ground terminal, the urging portion is formed integrally during blanking, and the plate edge of the urging portion is in contact with an inner wall of the inner metal shell.

4. The electrical connector of claim 1, wherein the inner metal shell is provided with a sidewall embedded in the insulating body, and the urging portion is in contact with the sidewall in the insulating body.

5. The electrical connector of claim 1, wherein the inner metal shell is provided with a sidewall exposed outside the insulating body, and the urging portion protrudes out of the insulating body to be in contact with the sidewall.

6. The electrical connector of claim 1, further comprising an upper insulator and a lower insulator, wherein the at least one row of terminals comprises an upper row of terminals and a lower row of terminals, the upper row of terminals are insert-molded into the upper insulator to form a first terminal module, the lower row of terminals are insert-molded into the lower insulator to form a second terminal module, the insulating body is formed by the first terminal module and the second terminal module along with the middle shielding sheet by insert molding again, and the insulating body wraps the first terminal module, the second terminal module and the middle shielding sheet.

7. The electrical connector of claim 1, wherein each of two sides of the middle shielding sheet is projected laterally to form a contact portion to be in contact with the inner metal shell, the contact portions are formed integrally when a sheet metal is blanked, and plate edges of the contact portions urge against the inner wall of the inner metal shell.

8. The electrical connector of claim 1, wherein among the at least one row of terminals, outermost terminals located at both sides are ground terminals.

9. The electrical connector of claim 1, wherein the insulating body comprises a base and a tongue extending forward from the base, and the urging portion is at least partially located in the base.

10. The electrical connector of claim 9, wherein the ground terminal comprises a main body located in the base, and the urging portion extends outward from the main body along a direction perpendicular to the main body.

11. An electrical connector, comprising:

an insulating body extending along the longitudinal direction;

an inner metal shell fixed on the insulating body;

a plurality of terminals disposed in the insulating body and comprising at least one ground terminal, wherein the ground terminal is horizontally projected outward to form an urging portion, and the urging portions are in contact with the inner metal shell; and an outer metal shell, enclosing the insulating body and the inner metal shell to form a mating cavity.

12. The electrical connector of claim 11, wherein the urging portion is connected with the inner metal shell by spot welding.

13. The electrical connector of claim 11, wherein a sheet metal is blanked to form the at least one ground terminal, the urging portion is formed integrally during blanking, and a plate edge of the urging portion is in contact with the inner wall of the inner metal shell.

14. The electrical connector of claim 11, wherein the at least one ground terminal comprises a main body extending along the longitudinal direction, and the urging portion extends perpendicular to the main body, and is coplanar with the main body.

15. The electrical connector of claim 11, wherein the insulating body comprises a base and a tongue extending forward from the base; and the inner metal shell comprises an annular portion fixed on the base and two covering portions extending forward from the annular portion, the two covering portions respectively cover an upper surface and a lower surface of the tongue, and the urging portion rigidly urges against the inner wall of the annular portion.

16. The electrical connector of claim 11, wherein the plurality of terminals are arranged in an upper row and a lower row, a middle shielding sheet is disposed between the upper row of terminals and the lower row of terminals, and plate edges of both sides of the middle shielding sheet are respectively projected horizontally to be in rigid contact with the inner metal shell.

* * * * *